United States Patent [19]

Bodine

[11] Patent Number: 4,487,554

[45] Date of Patent: Dec. 11, 1984

[54] SONIC PUMP FOR PUMPING WELLS AND THE LIKE EMPLOYING A ROD VIBRATION SYSTEM

[76] Inventor: Albert G. Bodine, 7877 Woodley Ave., Van Nuys, Calif. 91406

[21] Appl. No.: 582,158

[22] Filed: Feb. 27, 1984

Related U.S. Application Data

[63] Continuation of Ser. No. 356,184, Mar. 8, 1982, abandoned.

[51] Int. Cl.[3] ..... F04F 7/00; B01F 11/00

[52] U.S. Cl. ..... 417/241; 366/600

[58] Field of Search ..... 417/240, 555 A, 211, 417/241; 366/600

[56] References Cited

U.S. PATENT DOCUMENTS

| | | | |
|---|---|---|---|
| 2,444,912 | 7/1948 | Bodine, Jr. | 417/241 |
| 2,553,541 | 5/1951 | Bodine, Jr. | 417/241 |
| 2,553,542 | 5/1951 | Bodine, Jr. | 417/241 |
| 2,723,721 | 11/1955 | Corsette | 417/555 A |
| 2,953,095 | 10/1960 | Bodine, Jr. | 417/241 |
| 3,191,537 | 6/1965 | Bodine | 417/241 |
| 3,255,699 | 6/1966 | Bodine, Jr. | 417/241 |
| 3,399,627 | 9/1968 | Jeep, Jr. et al. | 417/410 |
| 3,417,966 | 12/1968 | Bodine | 366/600 |
| 4,358,248 | 11/1982 | Bodine | 417/241 |

*Primary Examiner*—Carlton R. Croyle
*Assistant Examiner*—Timothy S. Thorpe
*Attorney, Agent, or Firm*—Edward A. Sokolski

[57] ABSTRACT

A tubing string forming a conduit is installed within a well. Contained within the tubing string and vibrationally isolated therefrom is a rod string. Mounted on the rod string and spaced therealong at intervals which are less than a quarter wavelength at the resonant vibration frequency of the rod string are a series of sonically responsive impeller pump elements. The rod string is suspended in the tubing string from a vibration generator comprising an orbiting mass oscillator. The orbiting mass oscillator is operated at a frequency such as to cause resonant standing wave vibration at the rod string, the vibrational energy causing the impeller elements to drive fluid from the well up the tubing string.

9 Claims, 13 Drawing Figures

SONIC PUMP FOR PUMPING WELLS AND THE LIKE EMPLOYING A ROD VIBRATION SYSTEM

This is a continuation of Ser. No. 356,184 filed Mar. 8, 1982 now abandoned.

This invention relates to the pumping of fluids from wells and the like, and more particularly to a method and apparatus employing sonic energy for effecting this end result.

Sonic pumps have been available for pumping oil wells and the like for quite a number of years. Typical such sonic pumps are described in my U.S. Pat. Nos. 2,444,912; 2,553,541; 2,553,542; 2,702,559; 2,953,095; 3,255,699; and 3,303,782. The systems of these prior art patents employ a tubular string forming a conduit which is placed within the well casing and which has a series of check valves positioned along the string. In these prior art systems, the tubing string is sonically vibrated by means of an orbiting mass oscillator at a resonant frequency to set up standing wave vibrations therealong with the vibratory energy effectively causing the check valves to pump fluid into the tubing and up out of the top thereof. In the aforementioned Pat. No. 2,444,912, a rod string portion provides the vibratory energy to the tubing string. In my co-pending application Ser. No. 102,857, filed Dec. 11, 1979, a system is described which is particularly useful for deep-well pumping in which a rod and tubing string are tightly tied together and driven in unison by the sonic energy.

The present invention provides an improvement over the aforementioned prior art in affording higher Q of the vibration system and more efficient pumping action of the impellers. This improved end result is achieved by employing a solid, highly elastic rod string as the vibratory member, this string being driven in resonant standing wave vibration by means of an orbiting mass oscillator coupled thereto. The rod string is contained within the tubing string substantially vibrationally isolated therefrom, such that the vibrational energy is not significantly transferred to the tubing. The tubing string is thus left quiescent and the rod string functions as the sole energy transmission path. Further, the impeller pump elements are spaced from each other along the rod a distance of less than a quarter wavelength therein of the vibrational energy at the resonant operational frequency, resulting in in-phase pumping action of adjacent impellers. The rod is solid in construction and made of a highly elastic material so that it has high Q characteristics for optimum efficiency of vibration. The rod string is surrounded by the fluid being pumped and thus damping is provided as regards unwanted lateral vibrations. As already noted, the use of a solid rod member rather than a tube as the vibrational element provides a lesser amount of wetted area for a given amount of mass resulting in less fluid damping of the vibration for a given weight of the column as compared with a tubing column, thereby resulting in a higher Q for the vibration system. The use of the rod further has the advantage of facilitating the removal thereof along with the impeller units for inspection and repair as may be necessary.

It is therefore an object of this invention to provide an improved sonic pump employing impellers therealong in which more efficient pumping action is provided.

It is a further object of this invention to provide an improved sonic pump in which vibrational energy is more efficiently transmitted to a plurality of pumping elements.

Other objects of this invention will become apparent as the description proceeds in connection with the accompanying drawings of which FIG. 1 is a schematic drawing showing the general features of the invention;

Figure 5A:
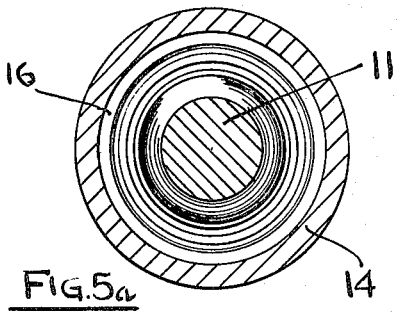
FIG. 5 is an elevational view with a partial cutaway section illustrating a first embodiment of an impeller pump element that may be employed in the device of the invention.
Figure 5:
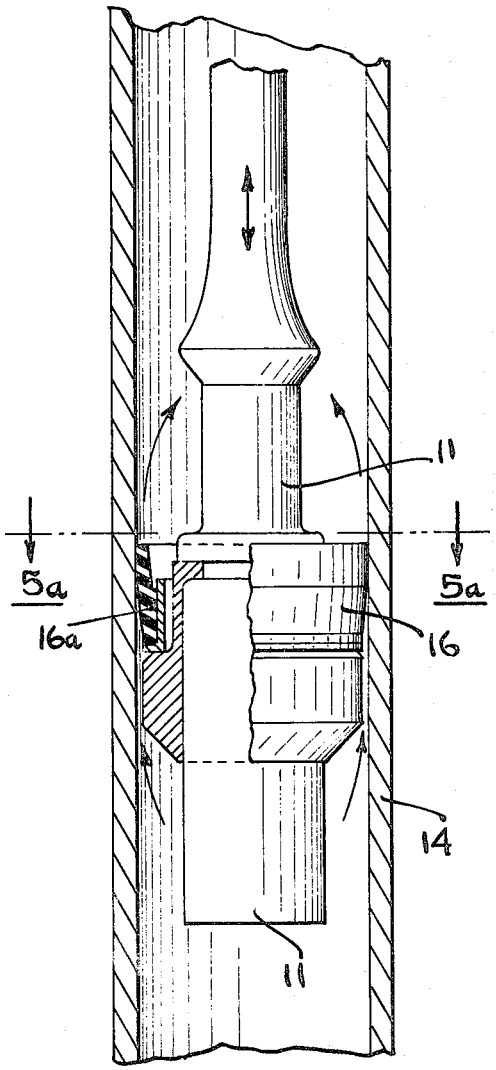
Figure 6:
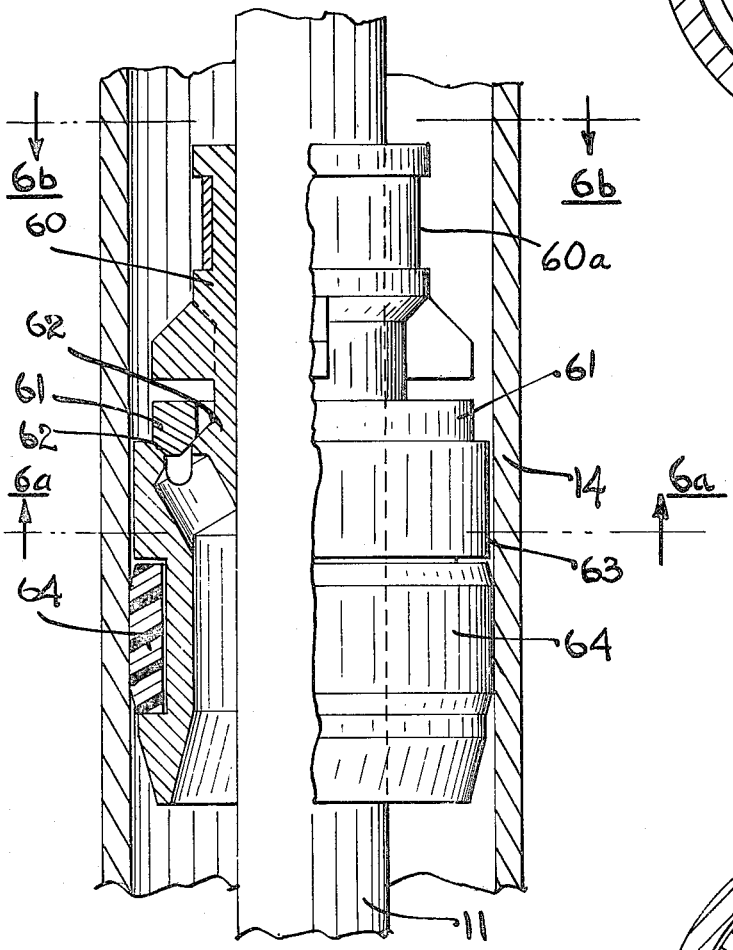
Figure 7A:
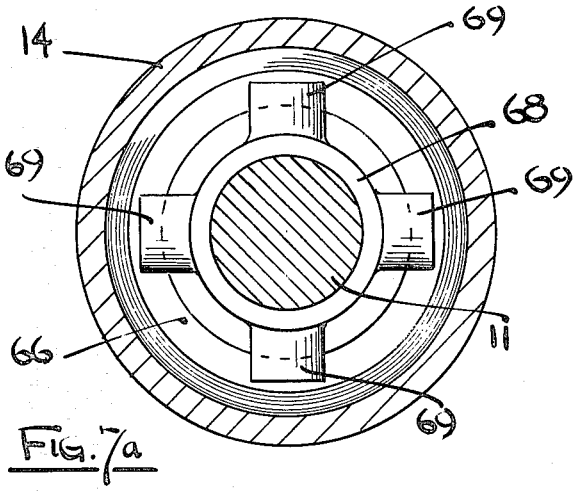
Figure 7C:
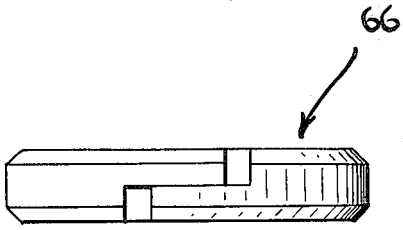
Figure 7:
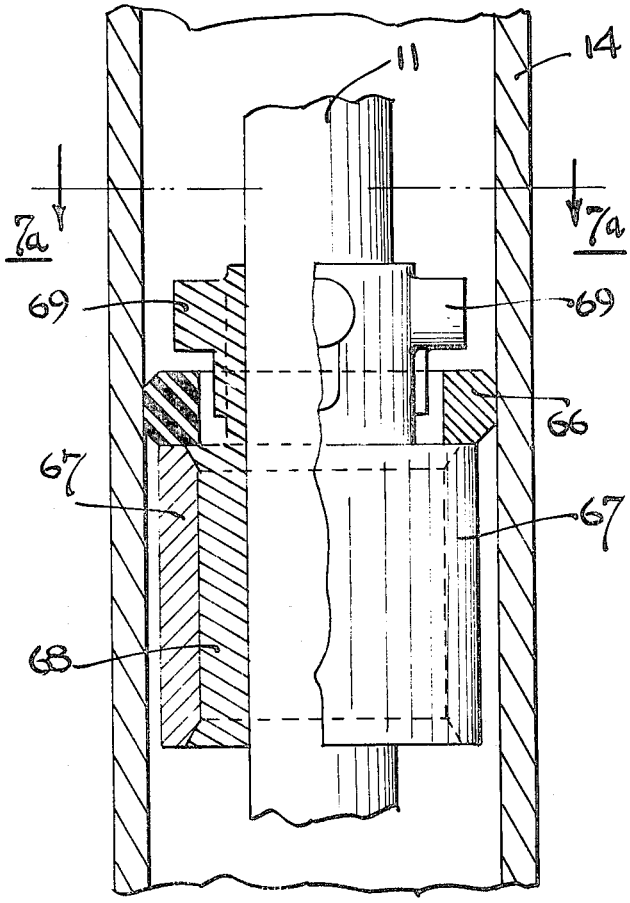
Figure 7B:
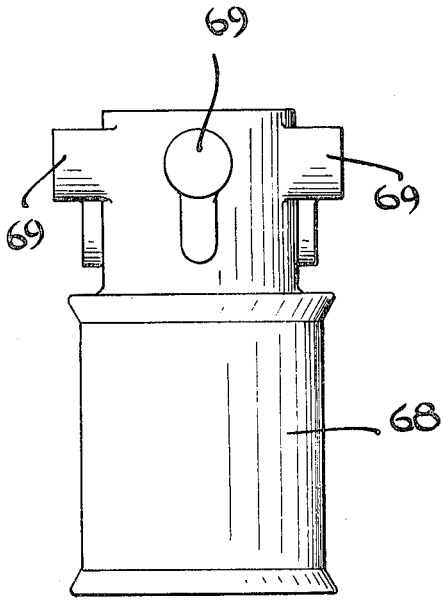

FIG. *5a* is a cross-sectional view taken along the plane indicated by *5a* -*5a* in FIG. 5;

FIG. 6 is an elevational view with a partial cutaway section of a second embodiment of an impeller pump element that may be employed in the device of the invention;

FIG. *6a* is a cross-sectional view taken along the plane indicated by *6a* —*6a* FIG. 6;

FIG. *6b* is a cross-sectional view taken along the plane indicated by *6b* —*6b* in FIG. 6;

FIG. 7 is an elevational view with partial cutaway section of a third embodiment of an impeller pump element that may be employed in the device of the invention;

FIG. *7a* is a cross-sectional view taken along the plane indicated by *7a* —*7a* in FIG. 7;

FIG. *7b* is a side elevational view of the impeller pump element of FIG. 7; and FIG. *7c* is a side elevational view of the poppet employed in the embodiment of FIG. 7.

It has been found most helpful in analyzing the operation of the device of this invention to analogize the acoustically vibrating circuit involved to an equivalent electric circuit. This sort of approach to analysis is well known to those skilled in the art and is described, for example, in Chapter 2 of *Sonics*, by Hueter and Bolt, published in 1955 by John Wiley and Sons. In making such an analogy, force F is equated with electrical voltage E; velocity of vibration u is equated with electrical current i; mechanical compliance $C_m$ is equated with electrical capacitance $C_e$; mass M is equated with electrical inductance L; mechanical resistance (friction) $R_m$ is equated with electrical resistance R; and mechanical impedance $Z_m$ is equated with electrical impedance $Z_e$. Thus, it can be shown that if a member is elastically vibrated by means of an acoustical sinusoidal force $F_0 \sin \omega t$ ($\omega$ being $2\pi$ times the frequency vibration), then $$Z_m = R_m + j\left(\omega M - \frac{1}{\omega C_m}\right) = \frac{F_0 \sin \omega t}{u} \quad (1)$$

Where $\omega M$ is equal to $1/\omega C_m$, a resonant condition exists, and and the effective mechanical impedance $Z_m$ is equal to the mechanical resistance, $R_m$, the reactive impedance components $\omega M$ and $1/\omega C_m$ cancelling each other out. Under such a resonant condition, velocity of vibration u is at a maximum, power factor is unity, and energy is most efficiently delivered to a load to which the resonant system may be coupled. Just as in electrical circuitry, maximum acoustical energy can be transferred from one circuit element to another where a good impedance match exists, i.e., where the two elements have like impedance. This fact becomes particularly significant in the instant invention where efficient energy transfer from the sonic generator to the rod string is desirable to assure optimum pumping action. By observation of Equation (1), it can be seen that the impedance $Z_m$ is high where the force $F_0$ is high, and velocity of vibration u is relatively low. For proper operation of the present invention, the pumping action of adjacent pumping impellers is made to occur in an in-phase relationship by spacing such impellers along the rod closer than a quarter wavelength at the resonant vibration frequency (wavelength=speed of vibrational wave in rod/frequency).

Also of particular significance in the instant invention is the attainment of high acoustical Q in the resonant vibration system to markedly increase the efficiency of the vibration thereof and to provide a maximum amount of cyclic energy. As for the equivalent electrical circuit, the Q of an acoustically vibrating circuit is defined as the sharpness of resonance thereof and is indicative of the ratio of the energy stored in each vibration cycle to the energy used in each cycle. Q is mathematically equated to the ratio between $\omega M$ and $R_m$. Thus, the effective Q of the acoustically vibrating circuit can be maximized to make for highly efficient high amplitude vibration by minimizing the effective friction in the vibrating circuit, and/or maximizing the effective mass in such circuit. The Q of the resonant circuit in the present invention is substantially increased by employing a rod string of a highly elastic material with less of its overall cross-sectional area wetted than a typical tubing string, thus minimizing the damping effect of the fluid.

In considering Equation (1), it should be kept in mind that this equation represents the total effective resistance, mass and compliance, in the acoustically vibrating circuit, and that these parameters are generally distributed throughout the system rather than being lumped in any one component or portion thereof.

It is to be noted that orbiting mass oscillators are utilized in the devices of the invention that automatically adjust their output frequency and phase to maintain resonance with changes in the characteristics of the load. Thus, in the face of changes in the effective mass and compliance presented by the load with changes in the conditions of the surrounding material as it is sonically excited, the system automatically is maintained in optimum resonant operation by virtue of the "lock-in" characteristics of Applicant's unique orbiting mass oscillators. The vibrational output of such orbiting mass oscillators is generated along a controlled predetermined coherent path to provide maximum output along the desired longitudinal axis. The orbiting mass oscillator automatically changes not only its frequency but also its phase angle and therefore its power factor with changes in the resistive impedance load to assure optimum efficiency of operation at all times.

Figure 1:
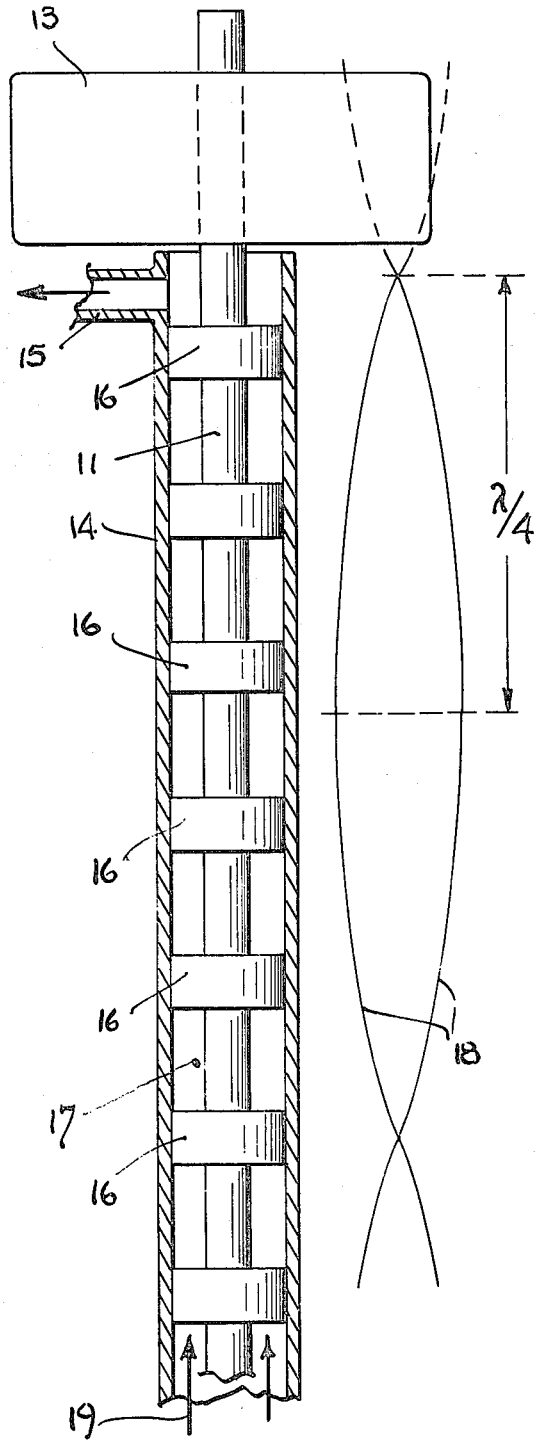

Referring now to FIG. 1, the device of the invention is schematically illustrated. Rod string 11 is suspended from vibration generator 13 and within tubing string 14. Vibration generator 13 may comprise an orbiting mass oscillator structure and an appropriate rotary drive mechanism of the type described in my U.S. Pat. No. 3,303,782. Rod 11 is solid and is fabricated of a highly elastic material, such as steel. Vibration generator 13 includes an orbiting mass oscillator and a suitable drive mechanism therefor, the vibrational output of the vibration generator being coupled to rod 11. The rod is suspend freely within tubing 14, this tubing being vibrationally isolated from the vibration generator 13 by means to be described further on in the specification. The orbiting mass oscillator of sonic generator 13 is operated at a frequency such as to cause resonant standing wave vibration of rod 11 as indicated by graph lines 18.

A plurality of sonic fluid impeller units 16 are mounted on rod 11 at spaced intervals therealong, the spacing between adjacent impeller units being substantially less than a quarter wavelength of the speed of sound at the resonant operating frequency at which rod 11 is vibrationally driven. It will be noted that impellers 16 are thus closely interspaced, referring to wave graph 18, such that adjacent impellers and their local regions of the rod are at like-phase regions of the wave pattern motion. An annulus 17 is formed between the inner wall of tubing 14 and the outer wall of rod 11. The vibratory energy in the rod string 11 causes the impellers 16 to impel well fluid up annular channel 17 as indicated by arrow 19, such fluid being exited from the well through outlet 15. Since the tubing is not part of the vibration system, it can be fabricated of a non-elastic material which is generally less expensive than elastic material and, of course, is not critical insofar as its vibrational properties are ooncerned. Various designs can be used for the fluid impelling units as long as they provide efficient unidirectional upward flow of the fluid. Typically, on the downstroke or down phase of each vibrational cycle, the impeller has valves which permit the liquid to pass easily therethrough. Then, during the upstroke of the vibrational cycle, downward flow through the impellers is prevented with the result that the impeller units act to impel the liquid column upwardly in an efficient manner, particularly because of the in-phase inertia of the short inductively reactive liquid column portions between successive impellers. Further benefit accrues from the in-phase driving of adjacent close spaced impellers along with the inductive drive effect of the adjacent short portions of the rod. Preferably, a low acoustical impedance is provided at the ends of the rod string to lessen any tendency to buckle, particularly during the compression phase of the vibration cycle. This end result is achieved by providing a soft spring mounting at the top end of the rod, with the lower end as well as all the other portions of the rod string being suspended freely within the tubing.

Figure 2:
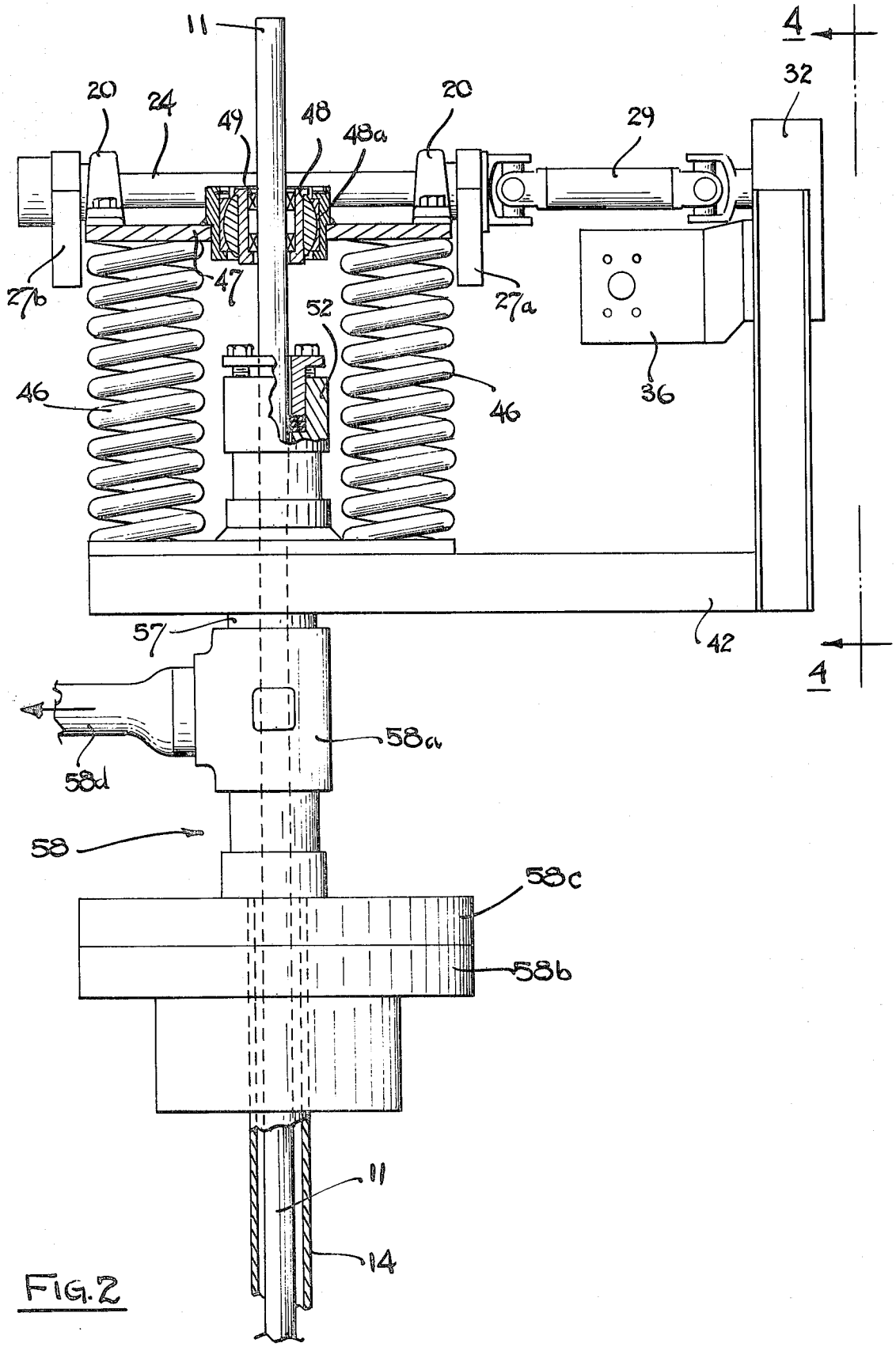
FIG. 2 is a side elevational view of one embodiment of the vibration generator of the invention.
Figure 3:
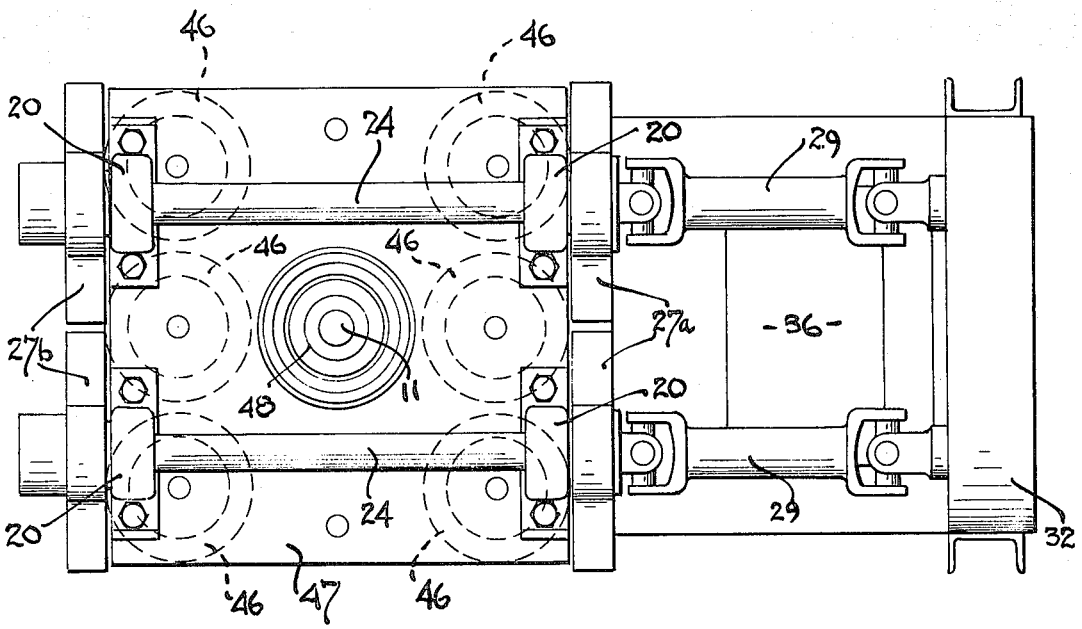
FIG. 3 is a top plan view of the embodiment of FIG. 2.
Figure 4:
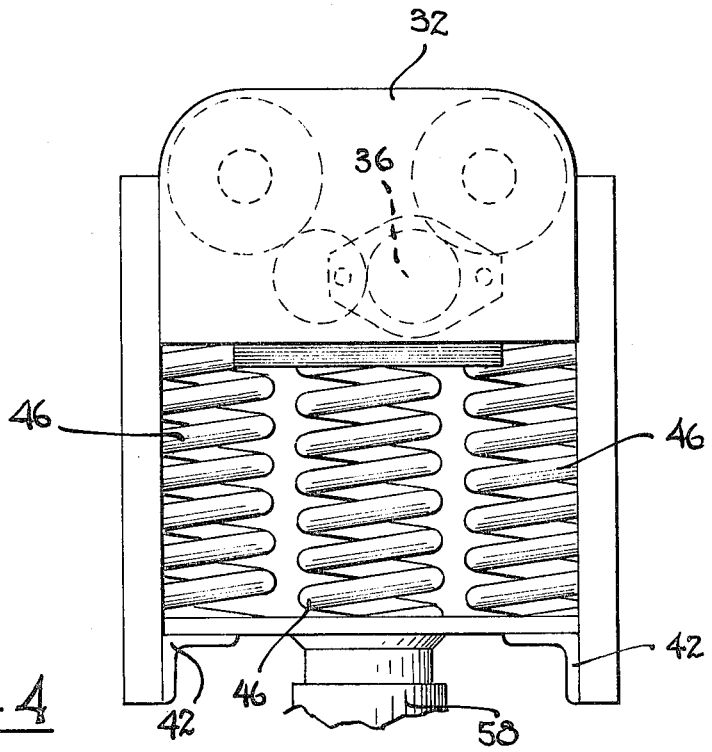
FIG. 4 is an end elevational view of the embodiment of FIG. 2.

Referring now to FIGS. 2–4, an embodiment of the vibration generator of the invention is illustrated. The assembly includes an upper platform 47 and a lower platform 42. The upper platform 47 is resiliently supported on the lower platform 42 by means of soft springs 46, thus providing vibrational isolation between the two platforms. Mounted on upper platform 47 on housing supports 20 are two pairs of half-cylinder rotors **27*a* and 27*b*, these rotors being rotatably supported by means of shafts 24 in the housing supports 20 on bearings (not shown) mounted therein. Each of the rotor pairs are driven in opposite directions in a predetermined phase relationship by means of drive shafts 29, the paired rotors 27 *a* and 27*b* being interconnected by means of shafts 24. Drive shafts 29 are rotatably driven through a phasing gear box 32 by means of an hydraulic motor 36** coupled to the gear box. The sonic oscillator is of the same general type and operates as described in my aforementioned U.S. Pat. No. 3,303,782.

Rod string 11 is suspended from upper platform 47, being supported on this platform by means of spherical bearing ball clamp assembly 48 and wedge collets 49 which grip the rod to the ball clamp. A spherical bearing 48*a* is provided in the ball clamp assembly which decreases bending vibration loads on the rod string in the event of any tipping vibration of upper platform 47. The rod 11 is fitted through stuffing box 52 which has suitable seal packing to prevent any leakage of liquid upwardly along the sides of the rod. The upper portion of the rod is polished to minimize wear along the portion of the rod that fits through stuffing box 52, with the reciprocal vibratory motion of the rod. A conventional pipe coupling 57 is provided on bottom platform 42, this coupling being threadably attached to conventional well head hardware 58 which includes a well head "T" 58*a* and casing and landing flanges 58*a* and 58*c*, respectively, the bottom end of this structure receiving the top end of the tubing string 14. Outflow for the liquid pumped up through tubing string 11 is provided by outflow line 58*d*.

As already noted, the rotors of the oscillator are driven in opposite direction in phased relationship to generate vibratory energy which is transferred to rod 11 through the clamp assembly 48 primarily in a longitudinal vibrational mode. The speed of motor 36 is adjusted to provide vibration at a resonant frequency of the vibration system including rod 11 (i.e., a frequency such as to cause resonant standing wave vibration of the rod). This vibrational energy, as already noted, is transmitted down the rod and effects pumping action of the impellers 16 mounted therealong (see FIG. 1). The rod 11 is suspended freely within the well tubing string 14 and isolated from vibrating the other surrounding hardware on the platform.

Various types of impeller units may be employed, various embodiments thereof being shown in FIGS. 5–7. Referring to FIGS. 5 and 5A, a first embodiment employing a cup-shaped impeller is illustrated. This type of impeller allows easy streamlined flow up around the outside of the cup, and at the same time this structure tends to impede downflow, thus enhancing the unidirectional flow action. The impeller member 16 is fixedly attached to the rod 11 so that it reciprocally vibrates therewith when the rod is vibrationally excited. Impeller member 16 has a resilient rubber edge portion 16*a* which is cup-shaped and flow is forced upwardly by the vibrational energy as indicated by the arrows, with the vibratory motion of cup-shaped edges 16*a*. Reverse downward motion of the fluid is impeded, the liquid with such downflow being prevented from passing between the sharp edge of the cup and the wall of the tubing. With the sonic acceleration effect present, the compliant outer edge of the cup momentarily expands against the tubing bore during the upward vibrational thrusting phase, while this edge is contracted inwardly away from the bore during the downward phase of impeller motion to permit the passage of fluid upwardly.

Figure 6B:
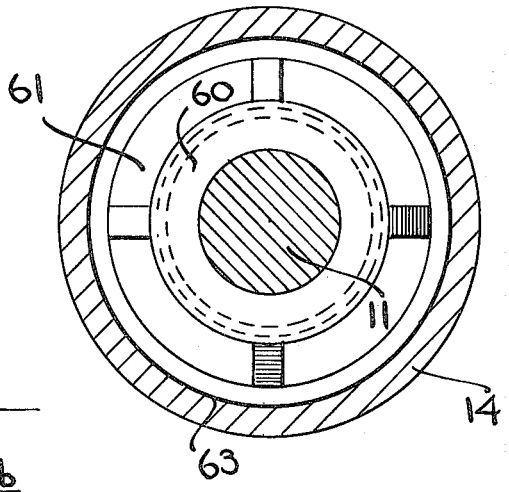
Figure 6A:
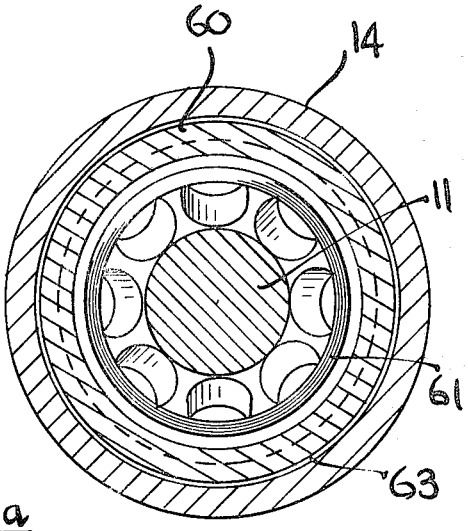

Referring now to FIGS. 6, 6A and 6B, a second embodiment of the impeller of the invention is illustrated. This particular embodiment employs a check valve (poppet type impeller) wherein a check valve poppet member 61 in the form of a circular ring seats in a V-groove 62 formed in the impeller body. As for the previous embodiment, the impeller body portion 60 is fixedly joined to the outer wall of rod 11 such as by clamp ring 60*a*. A ring member 64, which may be of Teflon, is mounted on the body of the impeller in a groove provided therein in the nature of a piston ring to improve the sealing effect, this ring member engaging the inner wall of the tubing 14. With the vibratory motion of the impeller, fluid pumped through the poppet valves, these valves closing to downward flow during the upward vibratory phase. A clearance gap 63 is provided between the outer wall of the impeller and the inner wall of the tubing to permit fluid to be directed against ring 64 so as to momentarily expand and seal the ring against the tubing wall during the pressure pulse. The surfaces of the impeller and the piston ring surfaces in contact with the tubing are preferably fabricated of a soft material to provide compliant give for foreign material such as sand and the like that may pass through the impeller so as to minimize scratching or harsh rubbing on the tubing wall.

Referring now to FIGS. 7, 7A, 7B and 7C, a further embodiment of the impeller is illustrated. This embodiment employs a poppet valve element 66 in the form of an O-ring which also functions as a sealing ring. In its closed position (as shown in FIG. 7), the poppet valve 66 seats against cylindrical body and seating member 67 which forms a pressed-on part of the main body 68 of the valve which may be of a resilient packer material which is thus compressed and fixedly attached to rod 11 so that it vibrates therewith. The valve poppet ring 66 has loose pressure contact with the wall of the tubing and is retained with a small amount of vertical freedom relative to the valve body by means of poppet stops 69 which are fixed to main impeller body portion 68. While the liquid is moving upwardly with its acquired velocity from the sonic impulses, there is a coasting flow upward through the annulus around the valve body past the poppet seat. This liquid flow holds the poppet away from its seat. During the middle of the upstroke vibrational phase, after the sonic acceleration has developed a high upward velocity of the impeller assembly, this assembly reaches a speed high enough to catch up with the liquid velocity and to some degree momentarily even surpassing this velocity. This results in closing the valve poppet 66 and causing an impact between the total mass of the valve element and the short adjacent rod portion acting against the mass of the liquid column portion above this element. With the close spacing of the valve elements employed in this invention, adjacent valve elements and rod portions move generally in an in-phase relationship. Therefore, the short intervening portion of the liquid column that has to be accelerated by successive impact of each valve element and rod region is quite responsive. In this manner, kinetic energy pulses are added efficiently to the liquid column so as to effectively maintain more or less continuous upward movement between successive impulses of the valve units. During the upward pumping pulses, sufficient pressure is provided to momentarily close the poppet against its seat and simultaneously expand the poppet-piston outwardly so that it seals against the inner wall of the tubing to provide the needed sealing action at this time. Such closing of the poppet valve occurs only during a very small percentage of the overall work cycle due to the in-phase upward coasting motion of the fluid such that wear on the sealing piston is minimal.

Thus, an improved pumping action is achieved by providing relatively close spacing between successive impeller or valve elements (i.e., less than a quarter wavelength in the rod string at the frequency of the standing wave vibration). This assures that adjacent impellers accelerate in a substantially in-phase relationship to give a more unified pumping action. This close spacing effectively makes each impeller and the adjacent short section of rod to the next impeller behave as a mass reactance in the vibration system to give good solid pumping action. In the same vein, the short columns of liquid between the impellers also behave as mass reactances to the same effect.

While the invention has been described and illustrated in detail, it is to be clearly understood that this is by way of illustration and example only and is not to be taken by way of limitation, the spirit and scope of this invention being limited only by the terms of the following claims.

I claim:

1. A pumping system for pumping fluid out of a well comprising a tubing string conducting said fluid installed in said well and running down said well, a rod string fabricated of elastic material contained within said tubing string and running therealong, said rod string being spaced from the tubing string, vibration generator means for providing vibrational energy to said rod string at a frequency such as to effect resonant standing wave vibration of said rod string, and a plurality of sonic impeller elements fixedly mounted on said rod string at spaced intervals therealong, the spacing between said impeller elements being less than a quarter wavelength in said rod string at the frequency of said standing wave vibration, the sonic energy effecting pumping action of the impeller elements to pump the well fluid up said tubing string.

2. The system of claim 1 wherein said vibration generator means comprises an orbiting mass oscillator and means for rotatably driving said oscillator.

3. The system of claim 1 and further including means for suspending the rod string from said vibration generator means freely within the tubing string.

4. The system of claims 1 or 3 and further including means for providing vibrational isolation for said vibration generator means to minimize the coupling of sonic energy therefrom to other than said rod string.

5. The system of claim 4 wherein the means for providing vibrational isolation comprises a soft spring mount for supporting the vibration generator.

6. The system of claim 3 wherein said means for suspending the rod string from the vibration generator comprises a spherical bearing ball clamp assembly connected to the vibration generator and collet means for gripping the rod string to the ball clamp assembly.

7. The system of claim 1 wherein each of the impeller elements comprises a body portion fixedly attached to the rod string, a flexible cup-shaped member attached to said body portion, the edge of said cup-shaped member abutting against the inner wall of said tubing string, said edge expanding and contracting in response to the vibrational energy to effect the pumping action.

8. The system of claim 1 wherein each impeller element comprises a body portion fixedly attached to the rod string, a soft ring member surrounding said body member and in opposing relationship to the inner wall of the tubing string and poppet valve means in said body portion for impelling the fluid.

9. The system of claim 1 wherein each impeller element comprises a body portion fixedly attached to the rod string, and poppet valve means for effecting the impelling action comprising a resilient O-ring forming a poppet valve element installed loosely around said body portion, said O-ring abutting against the inner wall of the tubing string, a resilient poppet seat formed in the peripheral portion of said body portion immediately below said O-ring, and poppet stops extending outwardly from said body portion immediately above said O-ring to limit the upward travel thereof, the O-ring being driven upwardly away from its seat against said poppet stops during the downward excursions of the vibratory energy to permit upward fluid flow and downwardly against its seat and in sealing engagement against the tubing string wall during the upward excursions of the vibratory energy thereby preventing downward fluid flow.

* * * * *